US011953200B2

(12) United States Patent
Shaw

(10) Patent No.: US 11,953,200 B2
(45) Date of Patent: Apr. 9, 2024

(54) BURNER ASSEMBLY HAVING A BAFFLE

(71) Applicant: Carrier Corporation, Palm Beach Gardens, FL (US)

(72) Inventor: Robert Shaw, Indianapolis, IN (US)

(73) Assignee: Carrier Corporation, Palm Beach Gardens, FL (US)

( * ) Notice: Subject to any disclaimer, the term of this patent is extended or adjusted under 35 U.S.C. 154(b) by 480 days.

(21) Appl. No.: 17/253,283

(22) PCT Filed: May 24, 2019

(86) PCT No.: PCT/US2019/033949

§ 371 (c)(1),
(2) Date: Dec. 17, 2020

(87) PCT Pub. No.: WO2020/068181

PCT Pub. Date: Apr. 2, 2020

(65) Prior Publication Data

US 2021/0270460 A1 Sep. 2, 2021

Related U.S. Application Data

(60) Provisional application No. 62/737,476, filed on Sep. 27, 2018.

(51) Int. Cl.

| | |
|---|---|
| ***F23D 14/62*** | (2006.01) |
| ***F23D 14/70*** | (2006.01) |
| ***F24H 3/02*** | (2022.01) |

(52) U.S. Cl.

CPC ..... *F23D 14/70* (2013.01); *F23D 14/62* (2013.01); *F24H 3/025* (2013.01); *F23D 2210/00* (2013.01)

(58) Field of Classification Search

CPC ..... F23D 14/46; F23D 14/62; F23D 14/70; F23D 14/84; F23D 2210/00; F23C 5/00; F24H 3/025

USPC ..... 126/116 R

See application file for complete search history.

(56) References Cited

U.S. PATENT DOCUMENTS

| | | | | |
|---|---|---|---|---|
| 4,799,879 | A | 1/1989 | Laspeyres | |
| 5,062,790 | A | 11/1991 | Loberger et al. | |
| 5,240,409 | A * | 8/1993 | Xiong | B01F 25/3131 431/189 |
| 5,363,836 | A * | 11/1994 | Briggs | F24H 3/065 126/109 |
| 5,423,675 | A * | 6/1995 | Kratsch | F23D 14/64 431/328 |
| 6,106,276 | A | 8/2000 | Sams et al. | |

(Continued)

OTHER PUBLICATIONS

International Preliminary Report for Patentablity for International Application No. PCT/US2019/033949 dated Apr. 8, 2021.

(Continued)

*Primary Examiner* — Avinash A Savani

(74) *Attorney, Agent, or Firm* — Carlson, Gaskey & Olds, P.C.

(57) ABSTRACT

A burner assembly includes a burner box that defines an enclosure that has a burner plate opening. A mixing tube is in fluid communication with the burner box through a mixing tube opening that extends through the burner box. A baffle creates an enclosure that at least partially separates the mixing tube opening from the burner plate opening.

23 Claims, 5 Drawing Sheets

(56) References Cited

U.S. PATENT DOCUMENTS

| | | | |
|---|---|---|---|
| 6,126,436 | A | 10/2000 | Cabrera et al. |
| 6,491,514 | B1 | 12/2002 | Hamad et al. |
| 6,913,457 | B2 | 7/2005 | Penfornis et al. |
| 7,788,926 | B2 | 9/2010 | Johnson et al. |
| 7,832,211 | B2 | 11/2010 | Ikeda et al. |
| 8,919,337 | B2 | 12/2014 | Schultz et al. |
| 8,985,999 | B2 | 3/2015 | Sherrow et al. |
| 9,127,837 | B2 | 9/2015 | Proscia et al. |
| 9,316,411 | B2 | 4/2016 | Sherrow et al. |
| 9,739,483 | B2 | 8/2017 | Akbarimonfared et al. |
| 9,970,679 | B2 | 5/2018 | Noman et al. |
| 2008/0131828 | A1* | 6/2008 | Ojiro ..... F23D 14/145 431/350 |
| 2013/0213379 | A1 | 8/2013 | Schultz et al. |
| 2015/0369495 | A1 | 12/2015 | Maricic et al. |
| 2017/0241668 | A1 | 8/2017 | Kowald |
| 2018/0209640 | A1 | 7/2018 | Asai |
| 2018/0209643 | A1 | 7/2018 | Montakhab et al. |

OTHER PUBLICATIONS

International Search Report and Written Opinion for International Application No. PCT/US2019/033949 dated Jul. 30, 2019.

* cited by examiner

BURNER ASSEMBLY HAVING A BAFFLE

CROSS-REFERENCE TO RELATED APPLICATIONS

This application claims priority to U.S. Provisional Application No. 62/737,476, which was filed on Sep. 27, 2018 and is incorporated herein by reference.

BACKGROUND

This disclosure relates to a burner assembly for a furnace. More specifically, the disclosure relates to a baffle for use in a burner assembly used in a pre-mix combustion system in a furnace. During operation of the furnace, it is possible that an undesirable combustion tone will occur in the burner assembly that is unpleasant to those in the vicinity of the furnace. Therefore, there is a need to reduce or eliminate the production combustion tones during operation of a furnace.

SUMMARY

In one exemplary embodiment, a burner assembly includes a burner box that defines an enclosure that has a burner plate opening. A mixing tube is in fluid communication with the burner box through a mixing tube opening that extends through the burner box. A baffle creates an enclosure that at least partially separates the mixing tube opening from the burner plate opening.

In a further embodiment of the above, the burner box includes a pair of side walls, a pair of end walls, and a back wall facing the burner plate opening. The mixing tube opening extends through one of the pair of side walls, the pair of end walls, and the back wall.

In a further embodiment of any of the above, the baffle at least partially defines a premix flow path with at least one of the pair of side walls and the pair of end walls.

In a further embodiment of any of the above, the baffle at least partially defines the premix flow path with the back wall.

In a further embodiment of any of the above, the baffle includes a portion at least partially following a profile of the mixing tube opening in the burner box.

In a further embodiment of any of the above, the portion at least partially following a profile of the mixing tube opening is a curved portion.

In a further embodiment of any of the above, the baffle includes at least one wing that extends from the curved portion.

In a further embodiment of any of the above, at least one tab extends transverse from at least one wing.

In a further embodiment of any of the above, at least one flange extends from opposite sides of at least one wing and at least one tab.

In a further embodiment of any of the above, the baffle engages each of one of the pair of end walls or side walls and is spaced from each of the other of the pair of end walls or the pair of side walls.

In a further embodiment of any of the above, a burner plate is located in the burner plate opening.

In a further embodiment of any of the above, the burner plate includes a pair of burner plate side walls, a pair of burner plate end walls, and a burner plate back wall that all extend into the burner box.

In a further embodiment of any of the above, the pair of burner plate side walls and the pair of burner plate end walls include perforations. The back wall includes a plurality of protruding perforated disks.

In another exemplary embodiment, a furnace includes a heater exchanger. A burner assembly in thermal communication includes a burner box that defines an enclosure that has a burner plate opening. A mixing tube is in fluid communication with the burner box through a mixing tube opening and extends through the burner box. A baffle creates an enclosure at least partially separating the mixing tube opening from the burner plate opening. A blower is configured to direct air across the heat exchanger.

In a further embodiment of any of the above, the burner box includes a pair of side walls, a pair of end walls, and a back wall facing the burner plate opening. The mixing tube opening extends through one of the pair of side walls, the pair of end walls, and the back wall.

In a further embodiment of any of the above, the baffle at least partially defines a premix flow path with at least one of the pair of side walls and the pair of end walls.

In a further embodiment of any of the above, the baffle at least partially defines the premix flow path with the back wall.

In a further embodiment of any of the above, the baffle engages each of one of the pair of end walls or side walls and is spaced from each of the other of the pair of end walls or the pair of side walls.

In a further embodiment of any of the above, a burner plate is located in the burner plate opening. The burner plate includes a pair of burner plate side walls, a pair of burner plate end walls, and a burner plate back wall that all extend into the burner box.

In another exemplary embodiment, a method of reducing noise in a burner assembly includes the steps of positioning an air fuel mixing tube relative to a mixing tube opening in the burner box to create at least a portion of a Helmholtz Resonator. A baffle is located within the burner box to create an enclosure at least partially separating the mixing tube opening from a burner plate opening in the burner box. The position of the baffle is varied within the burner box to vary a length of an enclosure at least partially defined by the burner box and a back wall of the burner box to extend the Helmholtz Resonator and vary a resonant frequency.

DETAILED DESCRIPTION

Figure 1:
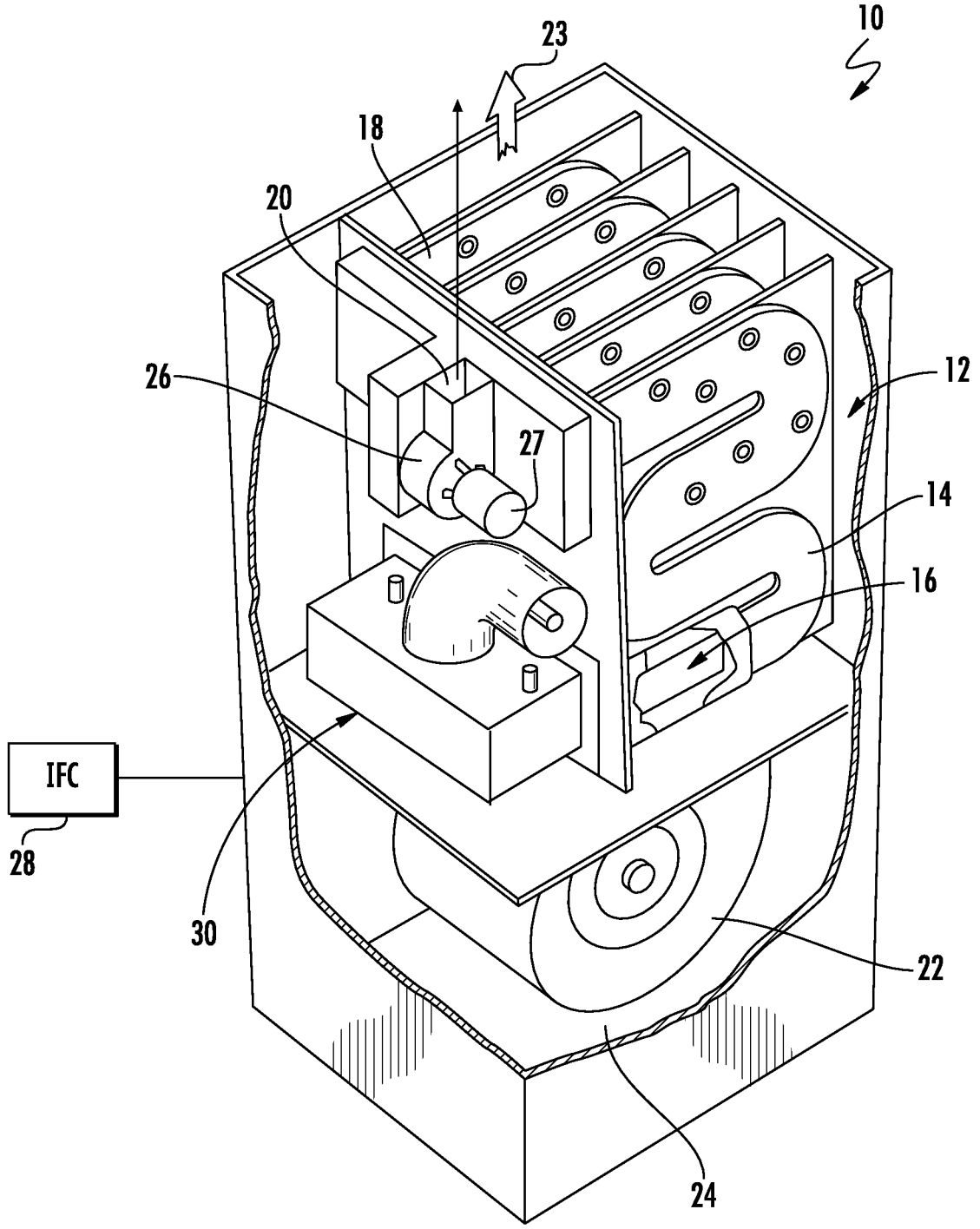
FIG. 1 illustrates an example furnace.

FIG. 1 illustrates a furnace 10. The furnace 10 may include a heat exchanger 12 having a plurality of individual heat exchanger coils 14. The heat exchanger coils or cells 14, which may be metallic conduits, may be provided in a serpentine fashion to provide a large surface area in a small overall volume of space. Each heat exchanger cell 14 includes an inlet 16 and an outlet 18. A burner assembly 30 is operatively associated with each inlet 16, and a vent 20 operatively associated with each outlet 18. The burner assembly 30 introduces a flame and combustion gases (not shown) into the heat exchanger cell 14, while vent 20 releases the combustion gases to atmosphere (through a flue or the like) after the heat of the flame and combustion gases are extracted by the heat exchanger 12 through a fan 26 having a motor 27. The motor 27 may be controlled by a processor 28, such as an integrated furnace control (IFC).

In order to extract the heat, an indoor blower assembly 22 may be provided to create a significant air flow across the heat exchanger cells 14. As the air circulates across the cells 14, it is heated and can then be directed to a space to be heated, such as a home or commercial building for example, by way of appropriate ductwork as indicated by arrow 23. The furnace 10 may also include a return 24 to enable air from the space to be heated to be recirculated and/or fresh air to be introduced for flow across the heat exchanger cells 14.

Figure 2:
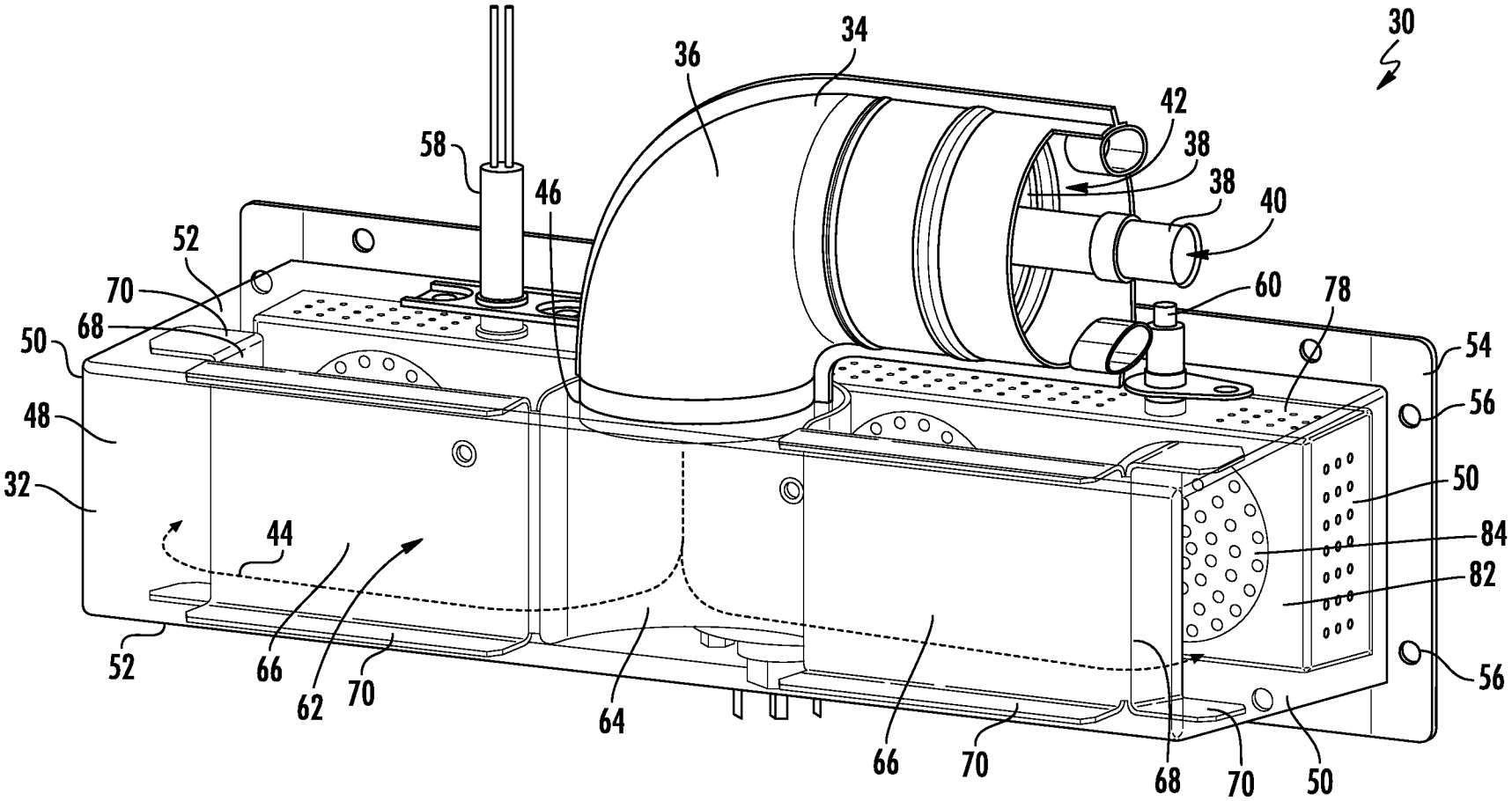
FIG. 2 is a perspective view of an example burner assembly.

FIG. 2 illustrates an example burner assembly 30 for use in the furnace 10. In the illustrated example, the burner assembly 30 includes a burner box 32 (shown as being transparent for illustration only) in fluid communication with a mixing tube 34 that provides a mixture of air and fuel into the burner box 32 around a baffle 62 to a burner distribution plate 72 for combustion.

In the illustrated example, the mixing tube 34 receives a supply of fuel and air from a fuel and air source, respectively. The fuel enters the mixing tube 34 through an inlet 40 to a fuel inlet tube 38 in fluid communication with the fuel source and the air enters to mixing tube 34 through an air inlet 42 that surrounds the fuel inlet tube 38. The mixing tube 34 also includes a mixing plate 35 that increases turbulence in the air entering the inlet 42 to encourage mixing of the air and fuel prior to an elbow 36 in the mixing tube 34 changing a direction of flow through the mixing tube 34 and into the burner box 32. The mixing tube 34 also forms at least a portion of a Helmholtz Resonator, which contributes to establishing a resonant frequency and an impedance relative to the burner assembly 30.

As the air and fuel mixture enters the burner box 32 through a mixing tube opening 46 in the burner box 32, the mixture of air and fuel generally follows the flow path 44 through the burner box 32 towards the burner distribution plate 72. The burner box 32 includes a back wall 48, a pair of opposite end walls 50, and a pair of opposite side walls 52 that at least partially define an opening opposite the back wall 48 for accepting the burner distribution plate 72. The opening is surrounded by a flange 54 having a plurality of attachment openings 56. The mixing tube opening 46 could be located in any of the back wall 48, pair of end walls 50, or pair of side walls 52.

A baffle 62 at least partially separates the incoming air-fuel mixture through the mixing tube 34 from the burner distribution plate 72. In the illustrated example, the burner box 32 and the baffle 62 at least partially define an enclosure that separates the mixing tube opening 46 from the burner distribution plate 72 by having the air-fuel mixture follow the flow path 44 instead of being directed to the burner distribution plate 72.

Figure 5:
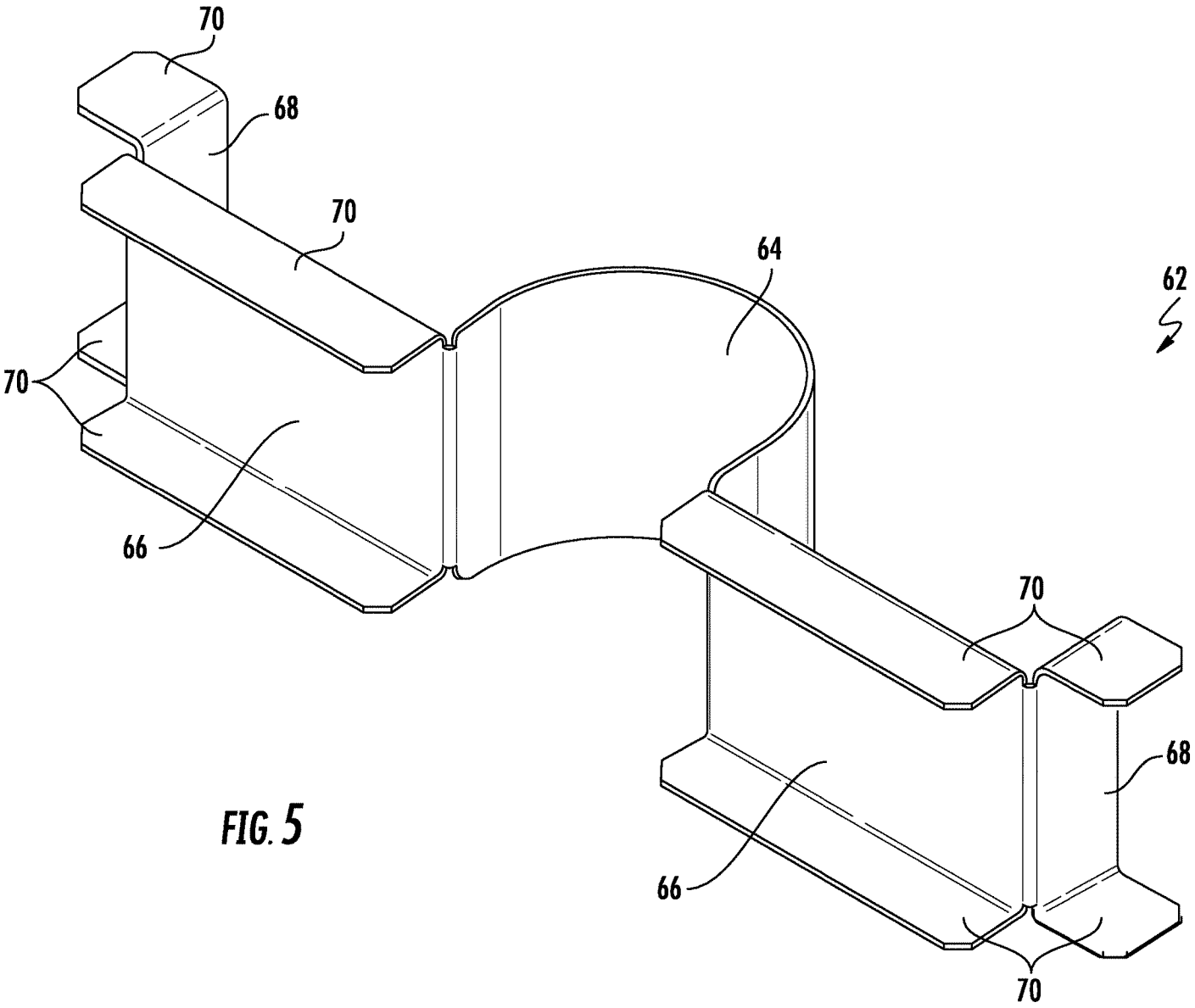
FIG. 5 is a perspective view of an example baffle.

In the illustrated example shown in FIG. 5, the baffle 62 includes a curved middle portion 64 that at least partially follows a profile of the mixing tube opening 46. However, other profiles could be used to follow the mixing tube opening 46. A separate wing 66 extends from opposite edges of the curved portion 64 and tabs 68 extend from distal ends of each of the wings 66. The curved portion 64, the wings 66, and the tabs 68 are in abutting contact with the side walls 52 of the burner box 32. The wings 66 and the tabs 68 include flanges 70 that extend perpendicular to the wings 66 and tabs 68 and are also in abutting contact with the side walls 52 of the burner box 32. In the illustrated example, the baffle 62 engages each of the side walls 52 and is spaced from each of the other of the pair of end walls 50. The baffle 62 could also have an opposite relationship with the pair of side walls 52 and the pair of end walls 50.

Figure 3:
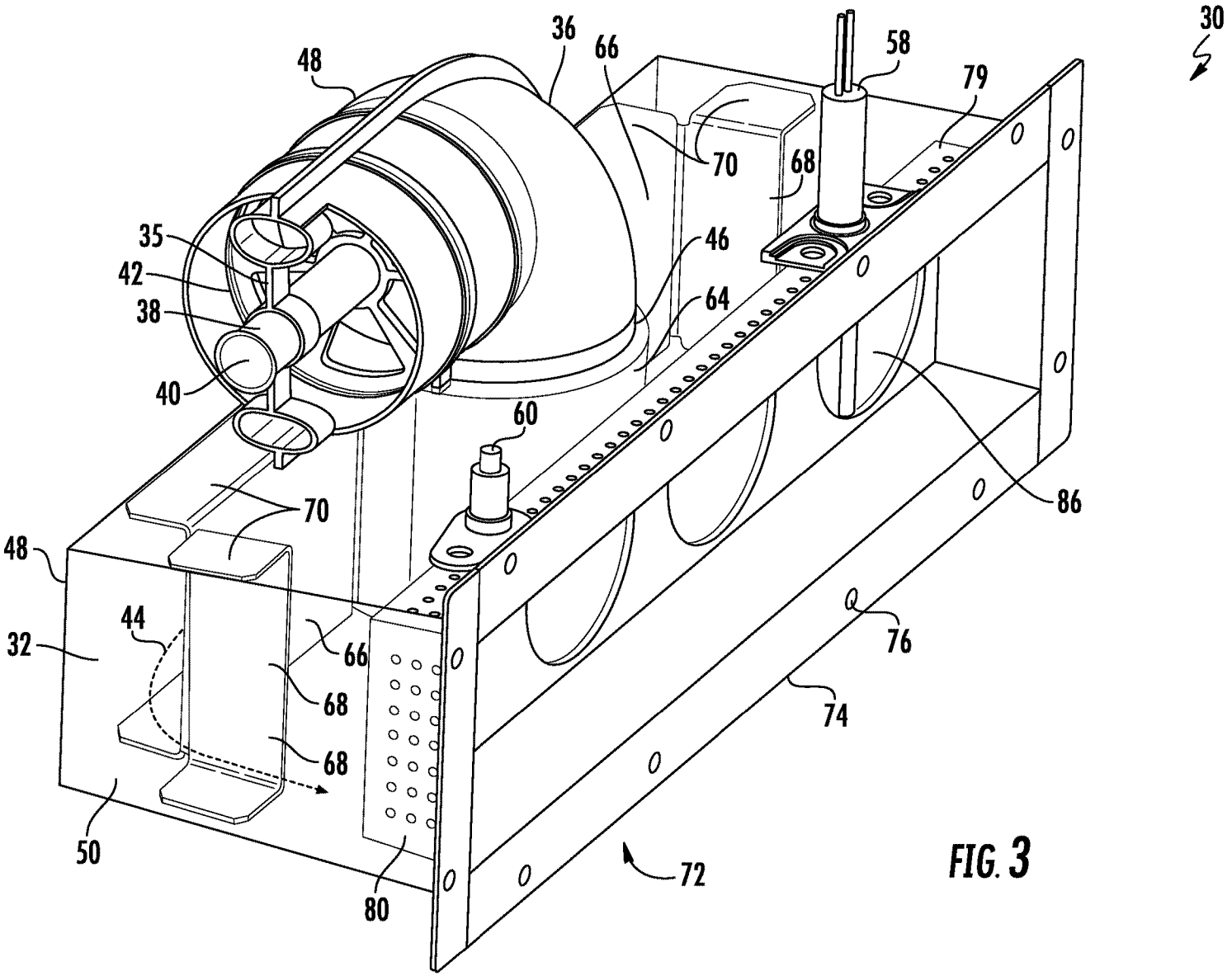
FIG. 3 is another perspective view of the example burner assembly of FIG. 2.
Figure 4:
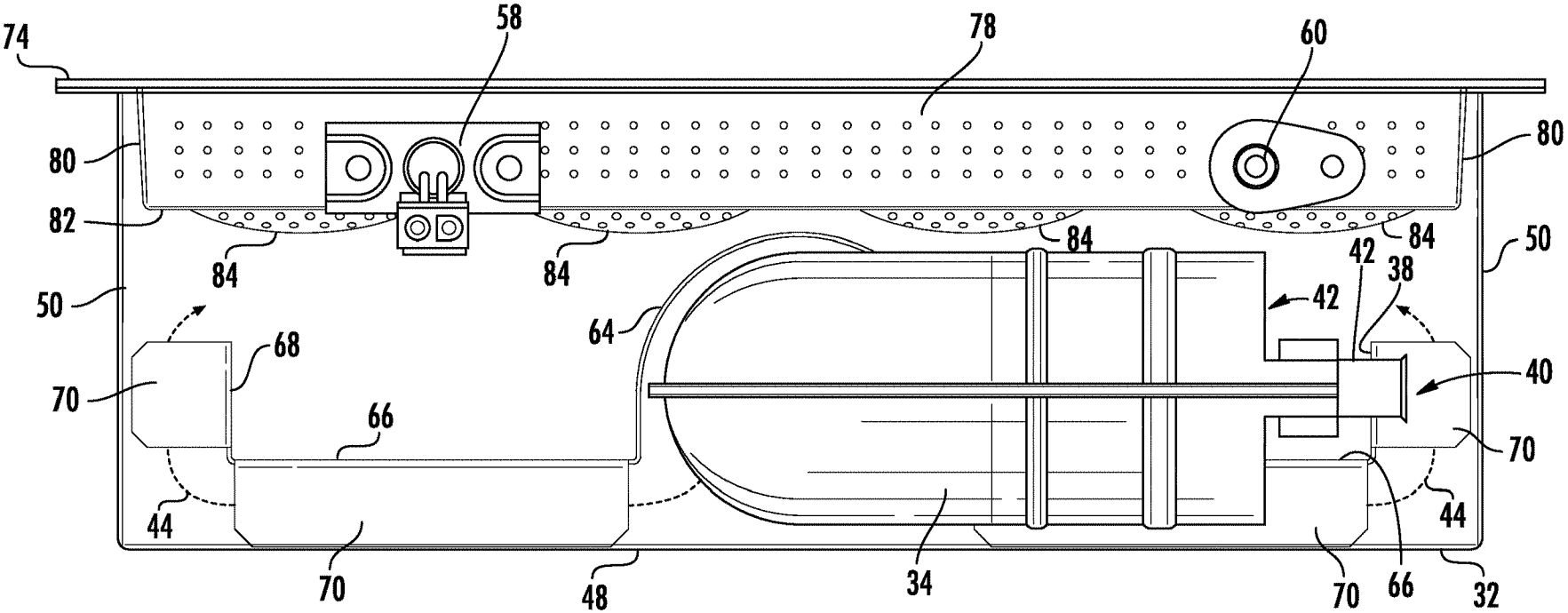
FIG. 4 is a top view of the burner assembly of FIG. 2.

As shown in FIGS. 3 and 4, the burner distribution plate 72 is accepted within the opening of the burner box 32 opposite the back wall 48. The burner distribution plate 72 includes a flange 74 surrounding a perimeter of the burner distribution plate 72 having attachment openings 76 that align with the attachment openings 56 in the flange 54 on the burner box 32. The attachment opening 56 and 76 allow for fasteners to secure the burner assembly 30 to another structure in the furnace 10.

The burner distribution plate 72 includes perforated side walls 78 and perforated end walls 80 that surround a partially perforated back wall 82. In the illustrated example, the back wall 82 includes multiple perforated discs 84 that protrude from the back wall 82 of the burner distribution plate 72. As shown in FIG. 3, an interior surface of the perforated side walls 78, perforated end walls 80 and the back wall is covered in a wired gauze 86 that facilitates transition of the air-fuel mixture into a combustion region of the burner distribution plate 72. The area upstream of the wire gauze 86 contributes to an upstream impedance of the furnace 10 and the area downstream of the wire gauze 86 contributes to a downstream impedance of the furnace 10.

One way to reduce the combustion tone from the burner assembly 30 is to change the upstream impedance in relation to the downstream impedance. In particular, it is desirable to achieve an upstream impedance that is larger than a downstream impedance in the furnace 10 to reduce or eliminate the presence of combustion tone in the burner assembly 30.

Increasing a length of the Helmholtz Resonator will increase the upstream impedance of the furnace 10 and reduce combustion tone. As discussed above, the mixing tube 34 functions as a portion of the Helmholtz Resonator and the portion of the burner box 32 enclosed by the baffle 62 separating the mixing tube opening 46 from the burner distribution plate 72 further extends the length of the Helmholtz Resonator. Varying a position of the baffle 62 within the burner box 32 varies of the length and/or volume of the premix flow path 44 which reduces the resonant frequency and increases the upstream impedance of the furnace 10.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A burner assembly comprising:

a burner box defining an enclosure having a burner plate opening;

a mixing tube in fluid communication with the burner box through a mixing tube opening extending through the burner box; and a baffle creating an enclosure at least partially separating the mixing tube opening from the burner plate opening, wherein the baffle separates an incoming air-fuel mixture into at least two opposing flow paths that flow around outer ends of the baffle to the burner plate opening.

2. The burner assembly of claim 1, wherein the burner box includes a pair of side walls, a pair of end walls, and a back wall facing the burner plate opening and the mixing tube opening extends through one of the pair of side walls, the pair of end walls, and the back wall.

3. The burner assembly of claim 2, wherein the baffle at least partially defines a premix flow path with at least one of the pair of side walls and the pair of end walls.

4. The burner assembly of claim 3, wherein the baffle at least partially defines the premix flow path with the back wall.

5. The burner assembly of claim 2, wherein the baffle includes a portion at least partially following a profile of the mixing tube opening in the burner box.

6. The burner assembly of claim 5, wherein the portion at least partially following a profile of the mixing tube opening is a curved portion.

7. A burner assembly comprising:

a burner box defining an enclosure having a burner plate opening, wherein the burner box includes a pair of side walls, a pair of end walls, and a back wall facing the burner plate opening;

a mixing tube in fluid communication with the burner box through a mixing tube opening extending through the burner box, and wherein the mixing tube opening extends through one of the pair of side walls, the pair of end walls, and the back wall; and a baffle creating an enclosure at least partially separating the mixing tube opening from the burner plate opening, wherein the baffle includes a portion at least partially following a profile of the mixing tube opening in the burner box, and wherein the portion at least partially following a profile of the mixing tube opening is a curved portion, and wherein the baffle includes at least one wing extending from the curved portion.

8. The burner assembly of claim 7, wherein at least one tab extends transverse from the at least one wing.

9. The burner assembly of claim 8, wherein at least one flange extends from opposite sides of the at least one wing and the at least one tab.

10. A burner assembly comprising:

a burner box defining an enclosure having a burner plate opening, wherein the burner box includes a pair of side walls, a pair of end walls, and a back wall facing the burner plate opening;

a mixing tube in fluid communication with the burner box through a mixing tube opening extending through the burner box, wherein the mixing tube opening extends through one of the pair of side walls, the pair of end walls, and the back wall; and a baffle creating an enclosure at least partially separating the mixing tube opening from the burner plate opening, wherein the baffle includes a portion at least partially following a profile of the mixing tube opening in the burner box, and wherein the baffle engages each of one of the pair of end walls or side walls and is spaced from each of the other of the pair of end walls or the pair of side walls.

11. The burner assembly of claim 1, including a burner plate located in the burner plate opening.

12. A burner assembly comprising:

a burner box defining an enclosure having a burner plate opening;

a mixing tube in fluid communication with the burner box through a mixing tube opening extending through the burner box;

a burner plate located in the burner plate opening, wherein the burner plate includes a pair of burner plate side walls, a pair of burner plate end walls, and a burner plate back wall that all extend into the burner box; and a baffle creating an enclosure at least partially separating the mixing tube opening from the burner plate opening.

13. The burner assembly of claim 12, wherein the pair of burner plate side walls and the pair of burner plate end walls include perforations and the burner plate back wall includes a plurality of protruding perforated disks.

14. A furnace comprising:

a heat exchanger;

a burner assembly in thermal communication including:

a burner box defining an enclosure having a burner plate opening;

a mixing tube in fluid communication with the burner box through a mixing tube opening extending through the burner box; and a baffle creating an enclosure at least partially separating the mixing tube opening from the burner plate opening, wherein the baffle separates an incoming air-fuel mixture into at least two opposing flow paths that flow around outer ends of the baffle to the burner plate opening; and a blower configured to direct air across the heat exchanger.

15. The furnace of claim 14, wherein the burner box includes a pair of side walls, a pair of end walls, and a back wall facing the burner plate opening and the mixing tube opening extends through one of the pair of side walls, the pair of end walls, and the back wall.

16. The furnace of claim 15, wherein the baffle at least partially defines a premix flow path with at least one of the pair of side walls and the pair of end walls.

17. The furnace of claim 16, wherein the baffle at least partially defines the premix flow path with the back wall.

18. A furnace comprising:

a heat exchanger;

a burner assembly in thermal communication including:

a burner box defining an enclosure having a burner plate opening, wherein the burner box includes a pair of side walls, a pair of end walls, and a back wall facing the burner plate opening;

a mixing tube in fluid communication with the burner box through a mixing tube opening extending through the burner box, wherein the mixing tube opening extends through one of the pair of side walls, the pair of end walls, and the back wall; and a baffle creating an enclosure at least partially separating the mixing tube opening from the burner plate opening, wherein the baffle engages each of one of the pair of end walls or side walls and is spaced from each of the other of the pair of end walls or the pair of side walls; and a blower configured to direct air across the heat exchanger.

19. The furnace of claim 14, including a burner plate located in the burner plate opening and the burner plate includes a pair of burner plate side walls, a pair of burner plate end walls, and a burner plate back wall that all extend into the burner box.

20. A method of reducing noise in a burner assembly comprising the steps of:

positioning an air fuel mixing tube relative to a mixing tube opening in a burner box to create at least a portion of a Helmholtz Resonator;

locating a baffle within the burner box to create an enclosure at least partially separating the mixing tube opening from a burner plate opening in the burner box;

separating an incoming air-fuel mixture into at least two opposing flow paths that flow around the baffle to the burner plate opening; and varying a position of the baffle within the burner box to vary a length of an enclosure at least partially defined by the burner box and a back wall of the burner box to extend the Helmholtz Resonator and vary a resonant frequency.

21. The method of claim 20, including forming the mixing tube opening in an outer wall of the burner box.

22. The furnace of claim 14, wherein the mixing tube opening is formed in an outer wall of the burner box.

23. The burner assembly of claim 1, wherein the mixing tube opening is formed in an outer wall of the burner box.

* * * * *